US010646744B2

(12) United States Patent
Steenekamp et al.

(10) Patent No.: US 10,646,744 B2
(45) Date of Patent: May 12, 2020

(54) PIVOTING WEIGHT ARM ASSEMBLY

(71) Applicant: Component Fabricators, Inc., Knoxville, TN (US)

(72) Inventors: Pierre Steenekamp, Knoxville, TN (US); Wayne Chermely, Knoxville, TN (US)

(73) Assignee: Component Fabricators, Inc., Knoxville, TN (US)

( * ) Notice: Subject to any disclaimer, the term of this patent is extended or adjusted under 35 U.S.C. 154(b) by 96 days.

(21) Appl. No.: 15/910,594

(22) Filed: Mar. 2, 2018

(65) Prior Publication Data

US 2019/0269963 A1 Sep. 5, 2019

(51) Int. Cl.

| | |
|---|---|
| ***A63B 21/00*** | (2006.01) |
| ***A63B 21/06*** | (2006.01) |
| ***A63B 21/062*** | (2006.01) |
| ***A63B 21/078*** | (2006.01) |

(52) U.S. Cl.

CPC ..... *A63B 21/4047* (2015.10); *A63B 21/0616* (2015.10); *A63B 21/0622* (2015.10); *A63B 21/4031* (2015.10); *A63B 21/4035* (2015.10); *A63B 21/00065* (2013.01); *A63B 21/0626* (2015.10); *A63B 21/078* (2013.01); *A63B 21/159* (2013.01); *A63B 2225/10* (2013.01)

(58) Field of Classification Search

CPC ..... A63B 21/4047; A63B 21/0616; A63B 21/0622; A63B 21/4031; A63B 21/4035; A63B 21/0626; A63B 21/00065; A63B 21/078; A63B 21/159; A63B 2225/10

See application file for complete search history.

(56) References Cited

U.S. PATENT DOCUMENTS

| | | | | |
|---|---|---|---|---|
| 5,688,216 | A | 11/1997 | Mauriello | |
| 6,579,213 | B1 * | 6/2003 | Webber | A63B 21/155 482/100 |
| 6,656,092 | B1 | 12/2003 | Fulks | |
| 6,669,607 | B2 | 12/2003 | Stawinski et al. | |
| 6,824,505 | B1 | 11/2004 | Chang | |
| 6,905,446 | B2 | 6/2005 | Greenland | |
| 7,094,185 | B2 | 8/2006 | Greenland | |
| 7,384,381 | B2 | 6/2008 | Webber et al. | |
| 7,641,602 | B2 | 1/2010 | Rogers et al. | |
| 7,815,552 | B2 * | 10/2010 | Dibble | A63B 21/045 482/103 |
| 7,909,742 | B2 | 3/2011 | Ish, III et al. | |
| 7,918,771 | B2 | 4/2011 | Rogers et al. | |

(Continued)

*Primary Examiner* — Loan B Jimenez
*Assistant Examiner* — Andrew M Kobylarz
(74) *Attorney, Agent, or Firm* — Pitts & Lake, P.C.

(57) ABSTRACT

A weight arm assembly for use with a weight lifting rack is provided, the weight arm assembly including a mounting bracket configured to be attached to a vertical surface in a fixed position, an arm mount configured to be coupled to the mounting bracket so as to be pivotable about a first axis, a stop member coupled to the arm mount and configured to move between an engaged position to prevent pivoting of the arm mount through interaction with the mounting bracket, and a disengaged position to allow pivoting of the arm mount, and a weight arm configured to be coupled to the arm mount, proximate a first end of the weight arm, so as to be pivotable about a second axis substantially orthogonal to the first axis.

18 Claims, 9 Drawing Sheets

(56) References Cited

U.S. PATENT DOCUMENTS

| | | | | |
|---|---|---|---|---|
| 8,147,390 | B2 | 4/2012 | Rogers et al. | |
| 8,257,233 | B2 | 9/2012 | Rogers et al. | |
| 8,491,449 | B2 | 7/2013 | Rogers et al. | |
| 8,657,726 | B2 | 2/2014 | Rogers et al. | |
| 8,870,720 | B1 | 10/2014 | Webber et al. | |
| 2007/0155596 | A1* | 7/2007 | Rogers ..... | A63B 21/0615 482/97 |

* cited by examiner

PIVOTING WEIGHT ARM ASSEMBLY

CROSS-REFERENCE TO RELATED APPLICATIONS

N/A

FIELD OF INVENTION

The present general inventive concept relates to weight lifting assembly, and, more particularly, to a pivoting weight arm assembly for use with a weight rack.

BACKGROUND

In the field of weight training, there is a multitude of different exercises and routines that call for different types of weights and weight bearing equipment. People are typically regulated to acquiring gym memberships to be able to access a large number of these exercises and pieces of equipment, due to the sheer amount of space needed to house and arrange the equipment in a usable way. Weight lifting racks are common in gymnasiums and even some homes, and are typically configured to be able to hold barbells at different positions and heights, as well as different modular equipment that may be attached and detached for different types of exercises. However, the changing out of such modular equipment to make way for other equipment and/or exercises is both time consuming and simply difficult to do, creating unwanted down time during the small amount of time people are able to allocate for exercise. Therefore, it would be desirable to have weight training equipment that could be attached to a weight lifting rack on a long term basis, and which could provide a variety of exercises and simply be positioned out of way when a user wants to perform exercises that do not involve the attached equipment.

BRIEF SUMMARY

According to various example embodiments of the present general inventive concept, a weight arm assembly is provided that can be attached to a weight lifting rack to perform a variety of exercises, and when not in use can be moved out of the way in a simple manner without being detached from the weight lifting rack.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by a weight arm assembly for use with a weight lifting rack is provided, the weight arm assembly including a mounting bracket configured to be attached to a vertical surface in a fixed position, an arm mount configured to be coupled to the mounting bracket so as to be pivotable about a first axis, a stop member coupled to the arm mount and configured to move between an engaged position to prevent pivoting of the arm mount through interaction with the mounting bracket, and a disengaged position to allow pivoting of the arm mount, and a weight arm configured to be coupled to the arm mount, proximate a first end of the weight arm, so as to be pivotable about a second axis substantially orthogonal to the first axis.

The foregoing and/or other aspects and advantages of the present general inventive concept may also be achieved by a weight lifting system including a weight lifting rack having at least two corresponding upright members configured to hold at least a weight lifting bar therebetween, and a pair of weight arm assemblies configured to be respectively attached to the upright members of the weight lifting rack, each of the weight arm assemblies respectively including a mounting bracket configured to be attached to one of the upright members in a fixed position facing away from a space between the upright members, an arm mount configured to be coupled to the mounting bracket so as to be pivotable about a first axis, a stop member coupled to the arm mount and configured to move between an engaged position to prevent pivoting of the arm mount through interaction with the mounting bracket, and a disengaged position to allow pivoting of the arm mount, and a weight arm configured to be coupled to the arm mount, proximate a first end of the weight arm, so as to be pivotable about a second axis substantially orthogonal to the first axis.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1A:
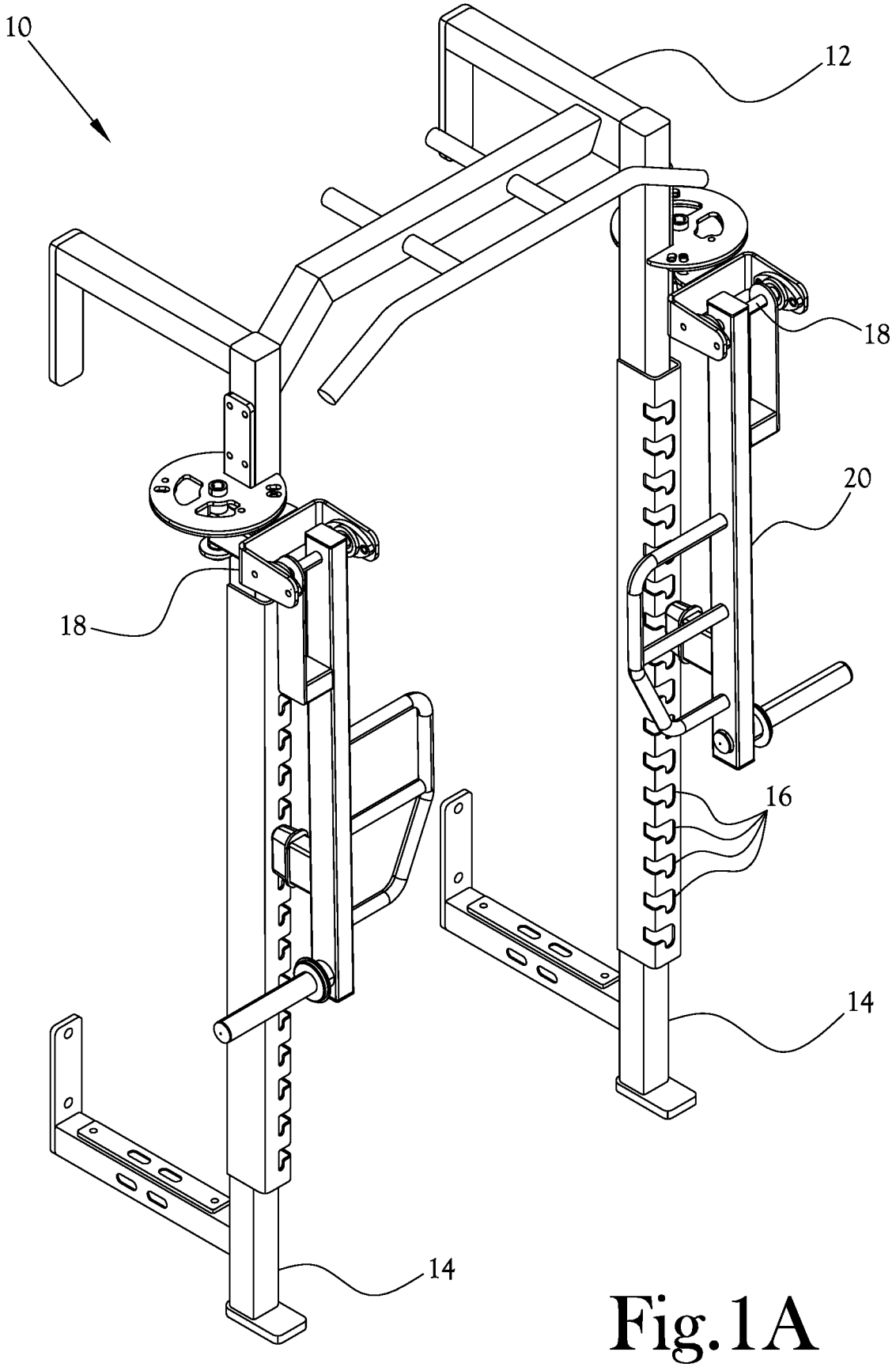
FIGS. 1A-B illustrate a weight lifting system according to an example embodiment of the present general inventive concept.

Reference will now be made to various example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and/or fabrication techniques described herein. Accordingly, various changes, modification, and equivalents of the structures and fabrication techniques described herein will be suggested to those of ordinary skill in the art. The progression of any fabrication operations described are merely examples, however, and any sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper," and the like may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Various example embodiments of the present general inventive concept may provide a weight arm assembly that can be attached to a weight lifting rack to perform a variety of exercises, and when not in use can be moved out of the way in a simple manner without being detached from the weight lifting rack. In various example embodiments, a user can simply rotate the weight arm assembly into one or more various positions to perform various arm exercises such as a forward press, a converging press, an outward press, and so on. The weight arm assembly may be arranged with a load peg, or weight horn, on which a number of free weight plates may be placed. Alternatively, or in combination, training bands can be placed on the load pegs and attached to a point on the weight lifting rack to provide different types of loads on the weight arm assembly. After a user is finished with any exercises using the weight arm assembly, the assembly can simply be rotated around to a stowed position out of the way, and the user can use the space for different exercises, such as putting other weights or modular assemblies on the weight lifting rack, and so on. Thus, the ease of being able to simply move the weight arm assembly out of the way, e.g., behind the uprights of the weight lifting rack, while still being attached to the weight lifting rack in a secure manner increases the utility, as well as the convenience, of the weight lifting rack. In an example embodiment of the present general inventive concept, after a user has performed a set of, for example, full body presses, the user can quickly move the weight arm assemblies out of the way to a stowed position, and move directly to using the rack for squat exercises. Such convenience makes the workout much more efficient, along with the added convenience.

Figure 1B:
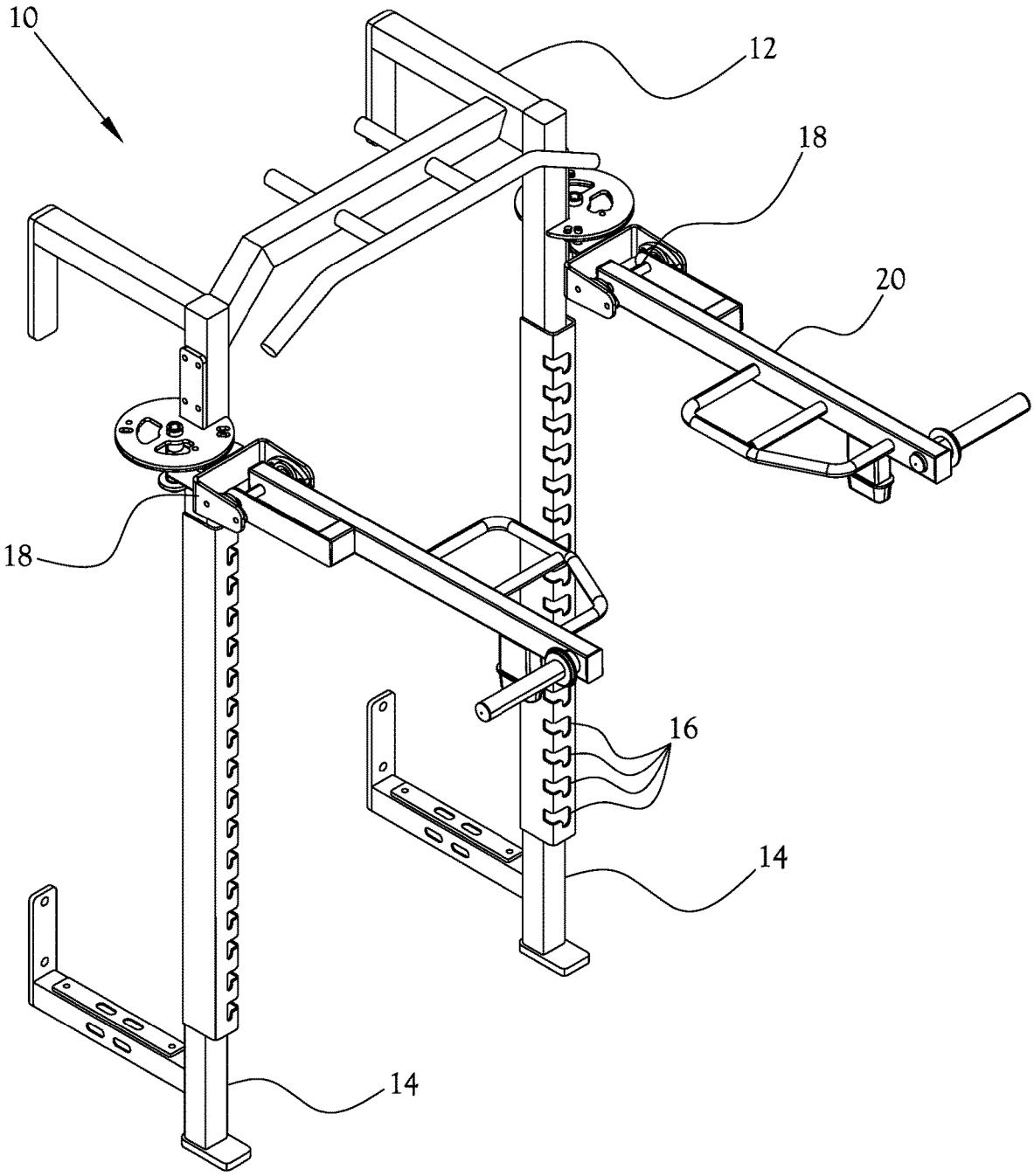

FIGS. 1A-B illustrate a weight lifting system according to an example embodiment of the present general inventive concept. FIG. 1A illustrates the weight lifting system 10 including a weight lifting rack 12 having two upright members 14. The upright members 14 each have a plurality of paired attachment portions 16 on which various supports for barbells, modular exercise assemblies, etc., may be interchangeably placed according to a user's desired exercise. Example embodiments of weight arm assemblies 18, each including a weight arm 20, are illustrated as being attached to the upright members 14 of the weight lifting rack 12, and are positioned in FIG. 1A to perform a straight forward pressing exercise in which a user can press the weight arms 20 directly out and parallel to each other. As described herein, the weight arm assemblies 18 are able to be rotated around to rest behind the upright members 14, and thus be out of the way of the user wanting to perform other exercises. FIG. 1B illustrates the weight lifting system 10 of FIG. 1A with the weight arms 20 pressed forward so as to raise up and away from the upright members 20.

Figure 2:
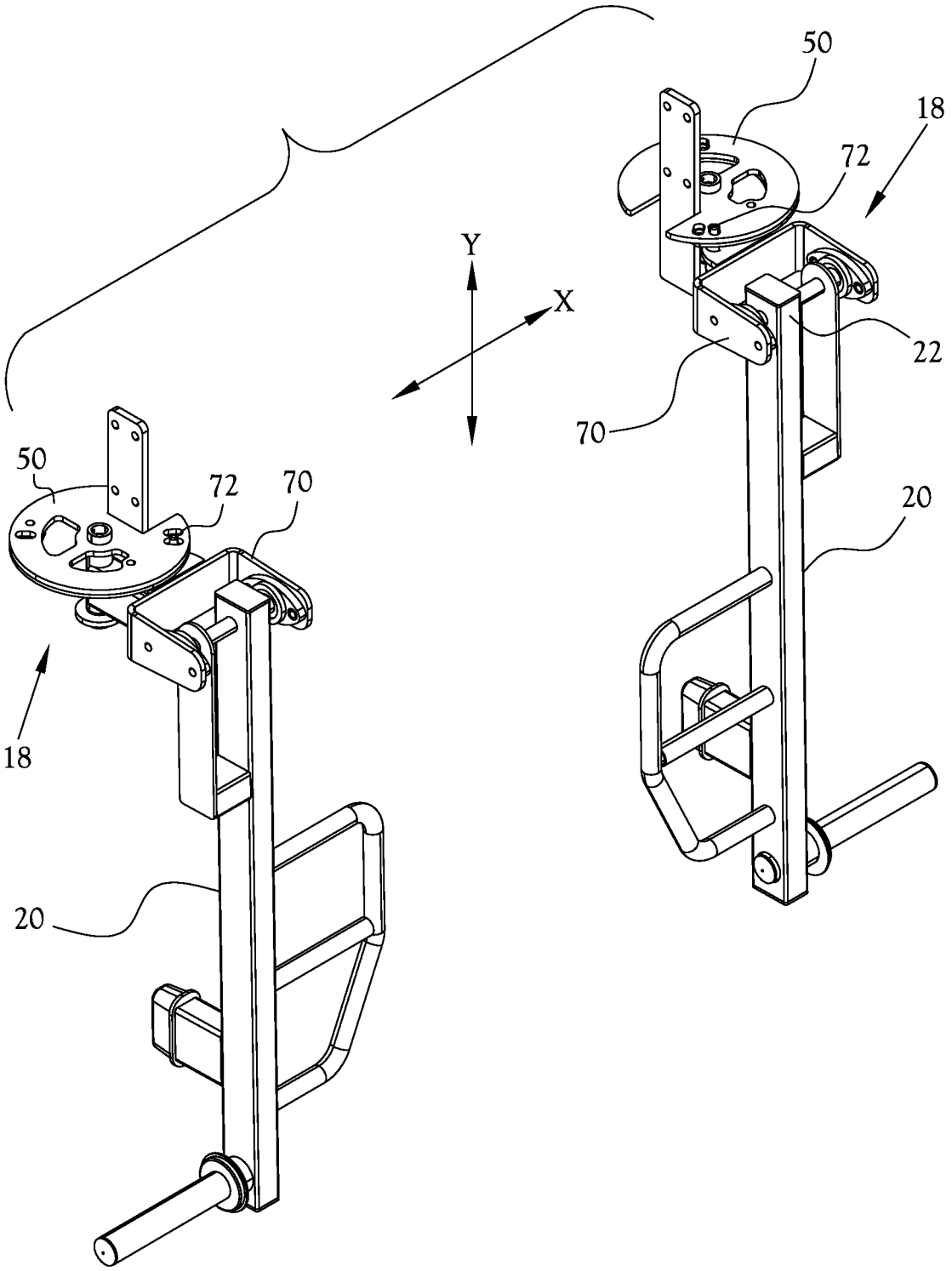
FIG. 2 illustrates the weight arm assemblies of FIGS. 1A-B isolated from the weight lifting rack.

FIG. 2 illustrates the weight arm assemblies 18 of FIGS. 1A-B isolated from the weight lifting rack 12. In the example embodiment illustrated in FIG. 2, each of the weight arm assemblies 18 include: a mounting bracket 50 configured to be attached to a vertical surface, which in this example embodiment is one of the upright members 14 of the weight lifting rack 12, in a fixed position; an arm mount 70 configured to be coupled to the mounting bracket 50 so as to be pivotable about a first axis y that is substantially vertical and matching the axis of the upright 14; and the weight arm 20 configured to be coupled to the arm mount 70, proximate a first end 22 of the weight arm 20, so as to be pivotable about a second axis x substantially orthogonal to the first axis y. Thus, in various example embodiments of the present general inventive concept, the first axis y is a substantially vertical axis, and the second axis x is a substantially horizontal axis. A stop member 72 coupled to the arm mount 70 is configured to move between an engaged position with the mounting bracket 50 to prevent pivoting of the arm mount 70, and a disengaged position to allow pivoting of the arm mount 70. The interaction between the stop member 72 and the mounting bracket 50 will be described in more detail herein. It is noted that various different example embodiments may have differently structured components in different arrangements without departing from the scope of the present general inventive concept.

Figure 3:
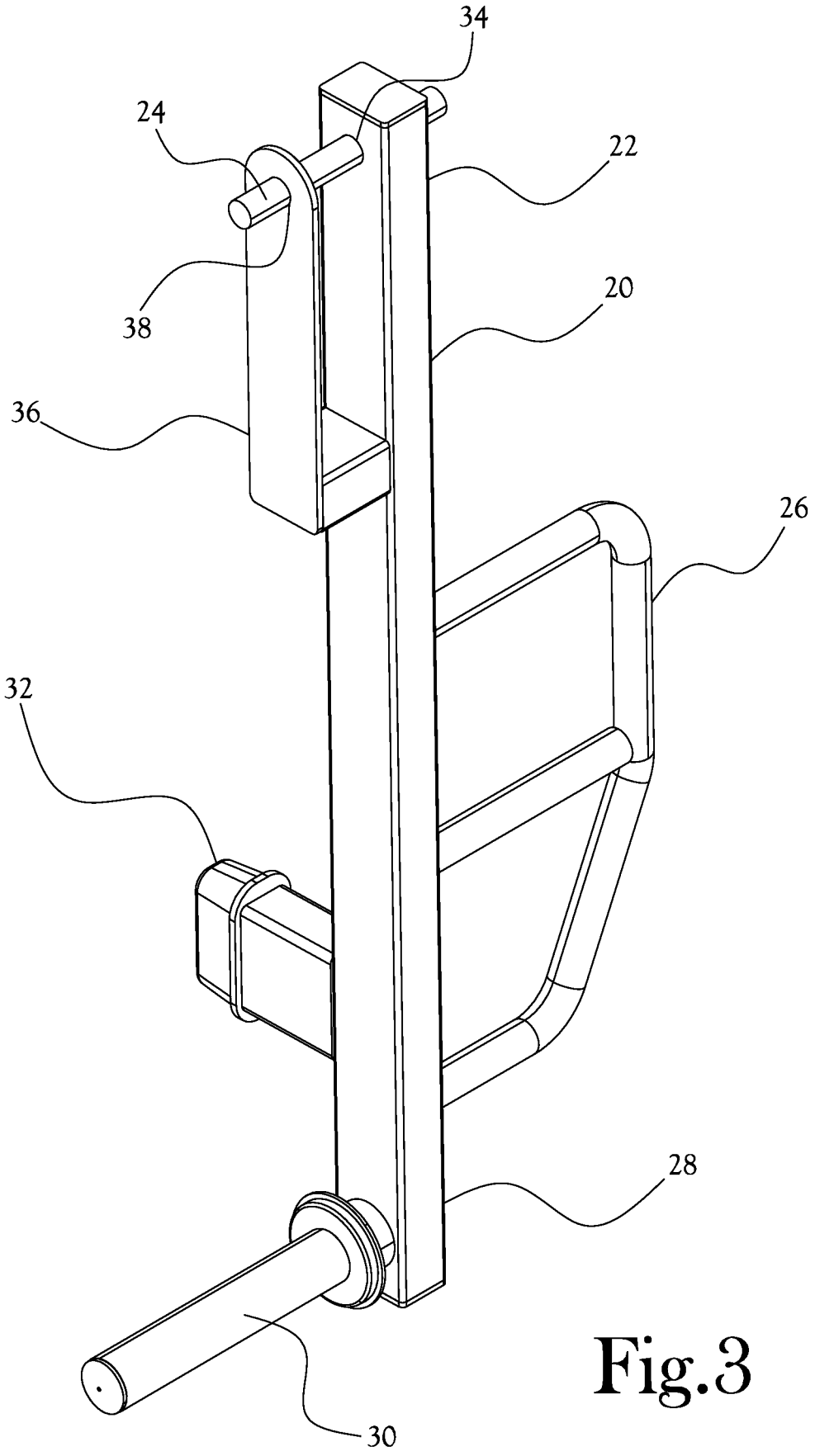
FIG. 3 illustrates a weight arm of the weight arm assemblies of FIGS. 1A-B according to an example embodiment of the present general inventive concept.

FIG. 3 illustrates a weight arm of the weight arm assemblies of FIGS. 1A-B according to an example embodiment of the present general inventive concept. The first end 22 of the weight arm 20 is formed with a first end aperture 34 that is sized to receive a spindle 24 which will be coupled to the arm mount 70. The longitudinal axis of the spindle 24 will be second axis x about which the weight arm 20 is able to pivot. Therefore, the weight arm 20 is supported at the first end 22 thereof by the spindle 24, which is in turn supported by the arm mount 70. Various different example embodiments of the present general inventive concept may provide different pivotable and supportive couplings for the weight arm 20, while maintaining the substantially horizontal axis about which the weight arm 20 pivots. A handle 26 is provided proximate a second end 28 of the weight arm 20. While different example embodiments of the present general inventive concept may include multiple different configurations of the handle 26, the example embodiment illustrated in FIG. 3 includes the handle 26 configured so as to have three handle portions extending substantially orthogonally from an inner side surface of the weight arm 20, i.e., the side surface facing the user, one handle portion connecting ends of two of the orthogonal portions so as to be parallel with the weight arm 20, and another handle portion connecting ends of two orthogonal portions in an angled arrangement. Various example embodiments may have more or fewer handle portions, and/or modular handles that can be changed out for different exercises or ranges of motion. A load peg, or weight hook, 30 is provided proximate the second end 28 of the weight arm 20 to support weight plates or other types of weight. The load peg 30 may also be connected to the weight lifting rack 12 or other anchored member by an elastic band to provide a different type of resistance exercise. A bumper 32 is provided at a rear surface of the weight arm 20 to stop the weight arm 20 from contacting the upright member 14 of the weight rack 12. The rear surface is relative to the front surface of the weight arm 20, which faces the direction in which the weight arm 20 moves away from the weight rack 12 during exercises. The example embodiment illustrated in FIG. 3 also includes a spacing member 36 provided proximate the first end 22 of the weight arm 20 to maintain a position of the weight arm 20 in a bracket of the arm mount 20 supporting the spindle 24, which is described in more detail herein. The spacing member 36 is also provided with a spacing member aperture 38, which corresponds in location with the first end aperture 34 in the first end 22 of the weight arm 20 itself, to receive the spindle 24. As can be understood from the illustration of FIG. 3, the handle 26 of the weight arm 20 can be pressed to move second end 28 of the weight arm 20 away from the upright member 14 as the first end 22 pivots around the spindle 24. Thus, by repositioning the arm mount 70 in the weight arm assembly 18, a pair of the weight arms 20 can be pressed forward in a parallel manner, or pressed forward in a converging manner, or pressed forward in an outward manner, providing three different motions with a simple and easy movement of the same assembly. The various handles 26 further vary the ranges of motion and exercises that are available with the weight arm assembly of the present general inventive concept. As the horizontal axis of the spindle 24 is maintained by the support coupling relationship between the weight arm 20 and the arm mount 70, the weight arm 20 may be pivoted around the horizontal axis in a variety of rotational positions of the arm mount 70 around the upright members 14.

Figure 4:
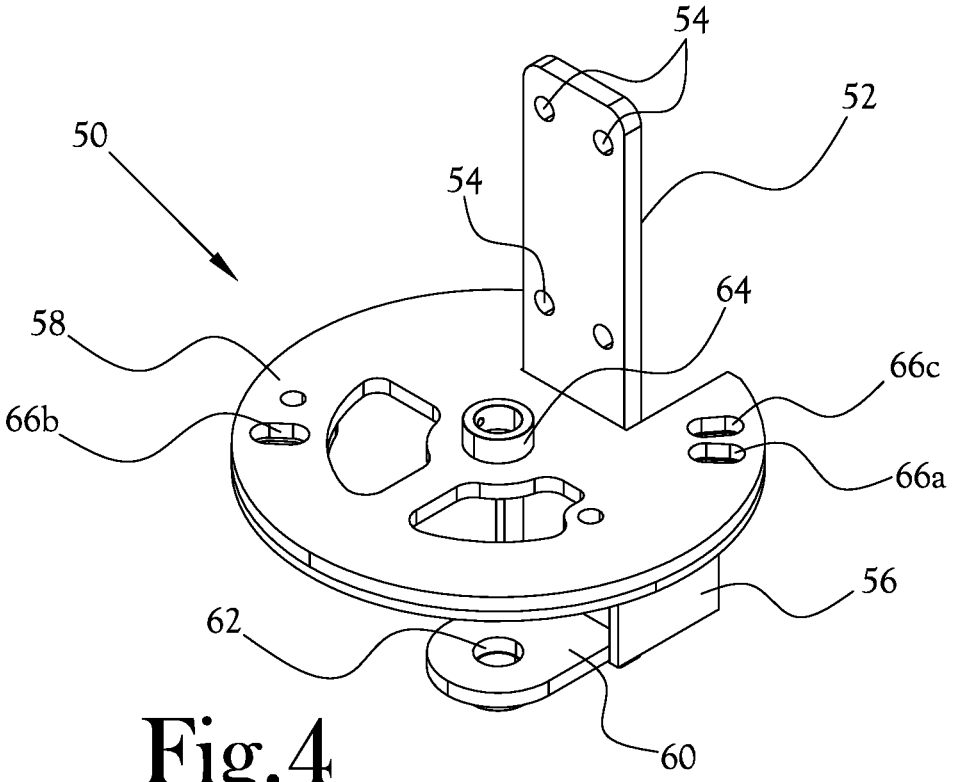
FIG. 4 illustrates a mounting bracket of the weight arm assemblies of FIGS. 1A-B according to an example embodiment of the present general inventive concept.

FIG. 4 illustrates a mounting bracket 50 of the weight arm assemblies of FIGS. 1A-B according to an example embodiment of the present general inventive concept. In the example embodiment illustrated in FIG. 4, the mounting bracket 50 includes a mounting portion 52 configured to be mounted to a vertical surface, which in this example embodiment is a flat plate configured to substantially conform to an upright member 14 of the weight lifting rack. Such upright members 14 are typically constructed in fairly standard sizes. The mounting portion 52 is provided with a plurality of through holes to receive fixing members such as, for example, bolts, screws, etc., to fix the contact plate to the upright member 14 in a fixed position. In various example embodiments of the present general inventive concept, corresponding holes may be provided in the upright member 14. In other various example embodiments, the mounting bracket 50 may be configured with a mounting portion that is configured to be received by one or more of the attachment portions 16 of the upright member 14, so that the weight arm assembly can be easily installed on the weight lifting rack 12. Such example embodiments may be provided with additional adhering members such as clamps, straps, etc., to further secure the mounting bracket to the upright member 14. The example embodiment illustrated in FIG. 4 includes a pair of reinforcement members 56 extending from opposite sides of the mounting portion 52 to be adjacent to surfaces of the upright member 14 that are adjacent to the surface facing the mounting portion 52, and provide extra protection against movement of the mounting bracket 50 relative to the upright member 14. The mounting bracket 50 further includes a top bracket member 58 extending horizontally from the mounting portion 52, and a bottom bracket member 60 extending horizontally from the mounting portion 52 and spaced apart from the top bracket member 58 such that there is space between the top and bottom bracket members 58,60 for a bushing 74 of the arm mount 70 to be coupled to the mounting bracket 50. The bushing 74 will be further described herein. In this example embodiment the top bracket member 58 is also formed with a recess to accept at least a portion of the upright member 14 attached to the mounting portion 52. The top and bottom bracket members 58,60 are respectively formed with corresponding aligned receiving portions 62 to receive opposite ends of a bolt or other such coupling member that passes through the bushing 74 of the arm mount 70 to couple the arm mount to the mounting bracket 50 in a way to allow the arm mount 70 to pivot about the axis y with which the bolt is aligned. The receiving portions 62 may be provided with a collar 64 extending from surfaces of the bracket members 58,60 facing away from one another, to provide extra support for the coupling bolt received therein. In various example embodiments of the present general inventive concept, once the bushing 74 of the arm mount 70 is aligned with the receiving portions 62 of the bracket members 58,60, a predetermined length bolt with a top portion of a higher diameter than the remaining portion can simply be placed through the collar 64 on the top bracket member 58 such that the top portion of the bolt rests against the collar 64, while the bolt extends through the bushing 74 and into the receiving portion 62 of the bottom bracket member 60 to rotatably couple the arm mount 70 to the mounting bracket 50. The mounting bracket 50 is also provided with a plurality of receiving stop member receiving portions 66 respectively configured to receive at least a portion of the stop member 72 at a plurality of rotational positions of the arm mount 70 to allow the stop member 72 to move to an engaged position to prevent pivoting of the arm mount 70. The stop member 72 will be described in more detail herein. In the example embodiment illustrated in FIG. 4, stop member receiving portions 66 are provided for three different positions of the weight arm assembly 18. Stop member receiving portion 66*a* receives a portion of the stop member 72 to hold the weight arm 20 in a position for a forward arm press exercise. Stop member receiving portion 66*b* receives a portion of the stop member 72 to hold the weight arm in a position to stow the weight arm assembly 18 out of the way when not in use. Stop member receiving portion 66*c* receives a portion of the stop member 72 to hold the weight arm 20 in a position for a converging arm press exercise. In the example embodiment of FIG. 4, the stop member receiving portion 66*a* is located substantially 180 degrees about the axis x from the stop member receiving portion 66*b*. Various example embodiments of the present general inventive concept may provide more or fewer stop member receiving portions 66, and in different configurations. For example, another stop member receiving portion could be provided near the stop member receiving portion 66*a*, but opposite to the stop member receiving portion 66*c*, to hold the weight arm 20 in a position for a diverging arm press exercise. The stop member receiving portions 66 are configured to receive at least a portion of the stop member 72 when the arm mount 70 is rotated to a position in which the stop member 72 is located directly under the respective stop member receiving portions 66. While the stop member receiving portions 66 of this example embodiment are illustrated as through holes in the top bracket member 58, in various example embodiments the stop member receiving portions may be formed as recesses on the underside of the top bracket member 58. As illustrated in FIG. 4, the top bracket member 58 may be configured with a substantially circular edge around much of the top bracket member 58 so that each of the stop member receiving portions 66 may be formed at a constant diameter from the bolt receiving portions 62, as the stop member 72 will travel at the same constant diameter from that axis during rotation of the arm mount 70.

Figure 5:
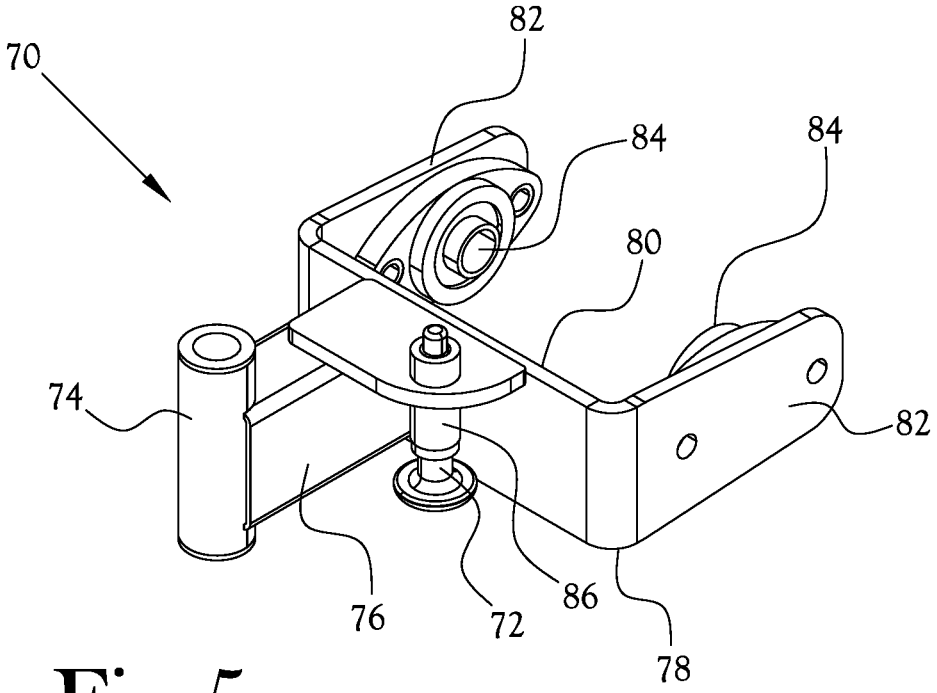
FIG. 5 illustrates an arm mount of the weight arm assemblies of FIGS. 1A-B according to an example embodiment of the present general inventive concept.

FIG. 5 illustrates an arm mount of the weight arm assemblies of FIGS. 1A-B according to an example embodiment of the present general inventive concept. In the example embodiment of FIG. 5, the arm mount 70 includes the stop member 72 coupled to the arm mount 70 and configured to move between an engaged position to prevent pivoting of the arm mount 70 through interaction with the mounting bracket 50, and a disengaged position to allow pivoting of the arm mount 70. The stop member 72 may be biased to move into the engaged position whenever the arm mount 70 is rotated to a point at which the stop member 72 is located under a stop member receiving portion 66 of the mounting bracket 50. The stop member 72 may be configured so as have a cylinder shape and to be oriented substantially vertically when the mounting bracket 50 is attached to the upright member 14. The stop member 72 may be seated in a barrel 86 to guide reciprocal vertical movement between the engaged and disengaged positions. The stop member 72 may be biased upward toward the top bracket member 58 by a spring 92 provided in the barrel 86, and may be provided with a flange 90 configured to contact a top of the spring 92 and prevent the stop member 72 from falling through spring 92 and barrel 86. The stop member 72 may have a bottom end extending through the bottom of the barrel 86 to be pulled by a user to move the stop member 72 to a disengaged position. The bottom end of the stop member 72 may be provided with a gripping portion 94 to provide a convenient grip for a user to pull on the stop member 72 in order to pivot the weight arm 20 to a different position. The top portion of the stop member 72 that enters the stop member receiving portions 66 when in an engaged position may abut the bottom of the top bracket member 58 without inhibiting rotation of the arm mount 70 when in a disengaged position. The arm mount 70 may include the bushing (which may be referred to as a bushing tube) 74 that is configured receive the bolt or other such coupling member received through the corresponding aligned receiving portions 62 of the top and bottom mounting brackets 58,60 of the mounting bracket 50 to form a rotational coupling such that the bushing 74 is rotatable about the coupling member. The arm mount 70 of FIG. 5 includes a spacer 76 extending orthogonally from the bushing 74, and a horizontal bracket 78 including a back portion 80 attached to an end of the spacer 76 opposite the bushing tube 74, and two side members 82 extending respectively from opposite ends of the back portion 80, wherein the two side members 82 of the horizontal bracket 78 are configured with corresponding aligned spindle receiving portions 84 on facing surfaces to receive opposite ends of the spindle 24 of the weight arm 20 to form the second axis x about which the first end 22 of the weight arm 20 is pivotable.

Figure 6A:
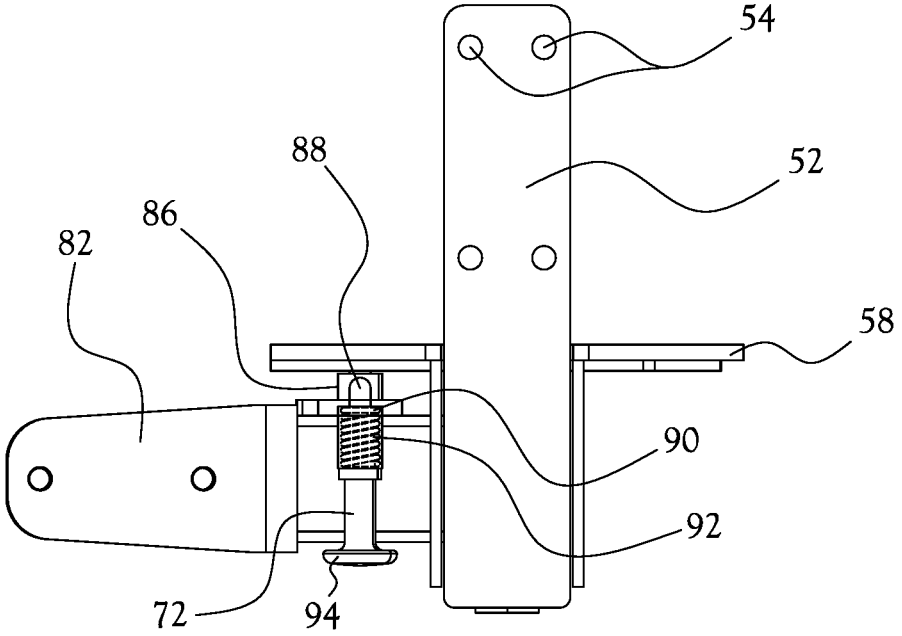
FIGS. 6A-B illustrate side views of the coupled arm mount and mounting bracket of the weight arm assemblies of FIGS. 1A-B according to an example embodiment of the present general inventive concept.
Figure 6B:
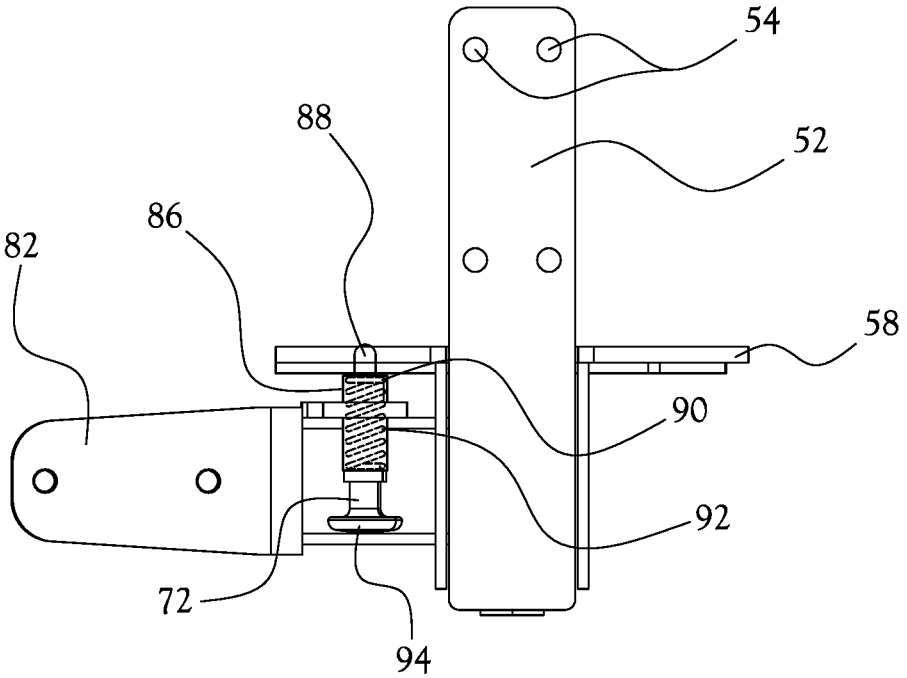

FIGS. 6A-B illustrate side views of the coupled arm mount 70 and mounting bracket 50 of the weight arm assemblies 18 of FIGS. 1A-B according to an example embodiment of the present general inventive concept. FIG. 6A illustrates the stop member 72 in a disengaged position, which allows rotational movement of the arm mount 70 about the second axis x. In other word, the arm mount 70 is able to pivot in relation to the mounting bracket 50 when the stop member 72 is disengaged from the mounting bracket 50. Although FIG. 6A illustrates the top end 88 of the stop member 72 as being spaced away from a bottom surface of the top bracket member 58 of the mounting bracket 50, as if being pulled into a lowered position by a user, it is understood that the top end 88 of the stop member 72 may rub against the bottom surface of the top bracket member 58 during rotational movement of the arm mount 70. FIG. 6B illustrates the stop member 72 in an engaged position, in which the top end 88 of the stop member 72 has entered one of the receiving portions 66 provided in the top bracket member 58 to stop rotational movement of the arm mount 70. In various example embodiments of the present general inventive concept, the receiving portions 66 may be recesses that stop upward movement of the stop member 72 when the top end 88 of the stop member 72 abuts the top of the recess. In other various example embodiments the receiving portions 66 may be through holes in the top bracket member 58, and the biased upward movement of the stop member 72 is stopped by the gripping portion 94 contacting a bottom of the barrel 86.

Figure 7A:
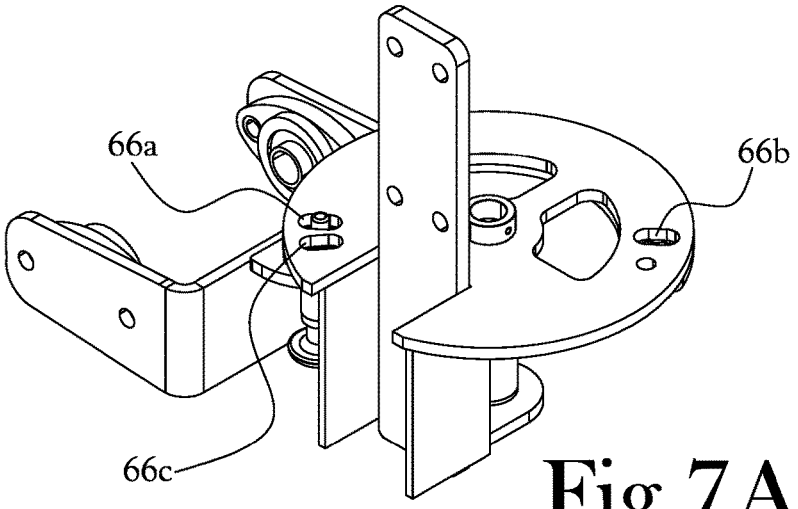
FIGS. 7A-C illustrate different positions of the arm mount and mounting bracket coupling of FIGS. 6A-B according to an example embodiment of the present general inventive concept.
Figure 7B:
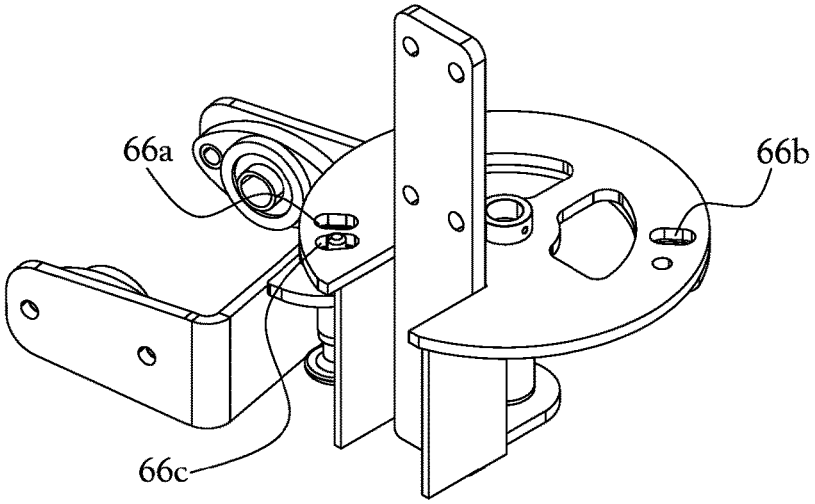
Figure 7C:
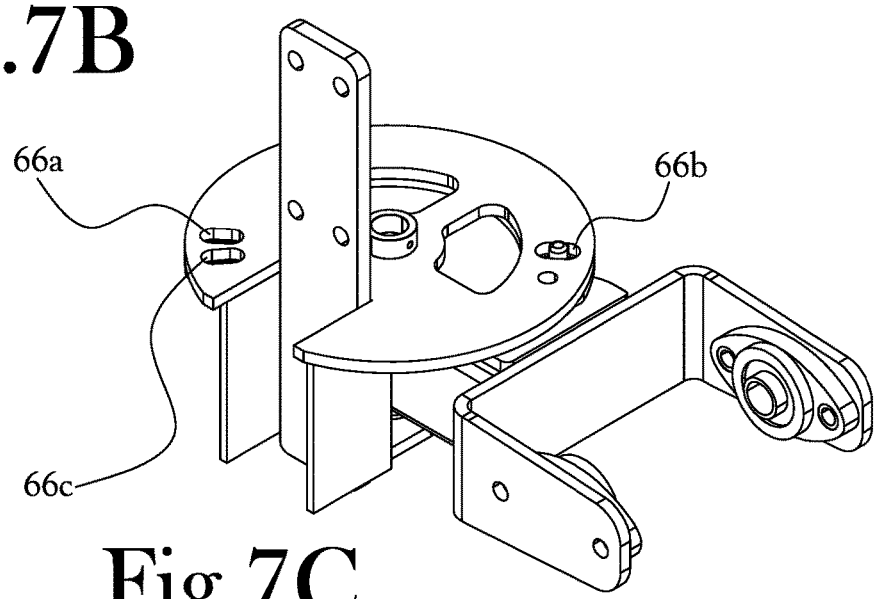

FIGS. 7A-C illustrate different positions of the arm mount and mounting bracket coupling of FIGS. 6A-B according to an example embodiment of the present general inventive concept. In the example embodiment illustrated in FIG. 7A, the stop member 72 has been received by the receiving portion 66*a* of the top bracket member 58, stopping rotation of the arm mount 70 in a position in which a coupled mounting arm 20 would be in position for the forward press exercise. In FIG. 7B, the stop member 72 has been received by the receiving portion 66*c* of the top bracket member 58, stopping rotation of the arm mount 70 in a position in which a coupled mounting arm 20 would be in position for the converging press exercise, assuming two of the weight arm assemblies 18 being installed on corresponding upright members 14. In the paired arrangement, the components of the weight arm assemblies are substantially mirror images of one another. In FIG. 7C, the stop member 72 has been received by the receiving portion 66*b* of the top bracket member 58, stopping rotation of the arm mount 70 in the stowed position for non-use of the weight arm assemblies 18, so that the space on and between the upright members 14 may be used for other exercises and/or equipment.

Figure 8:
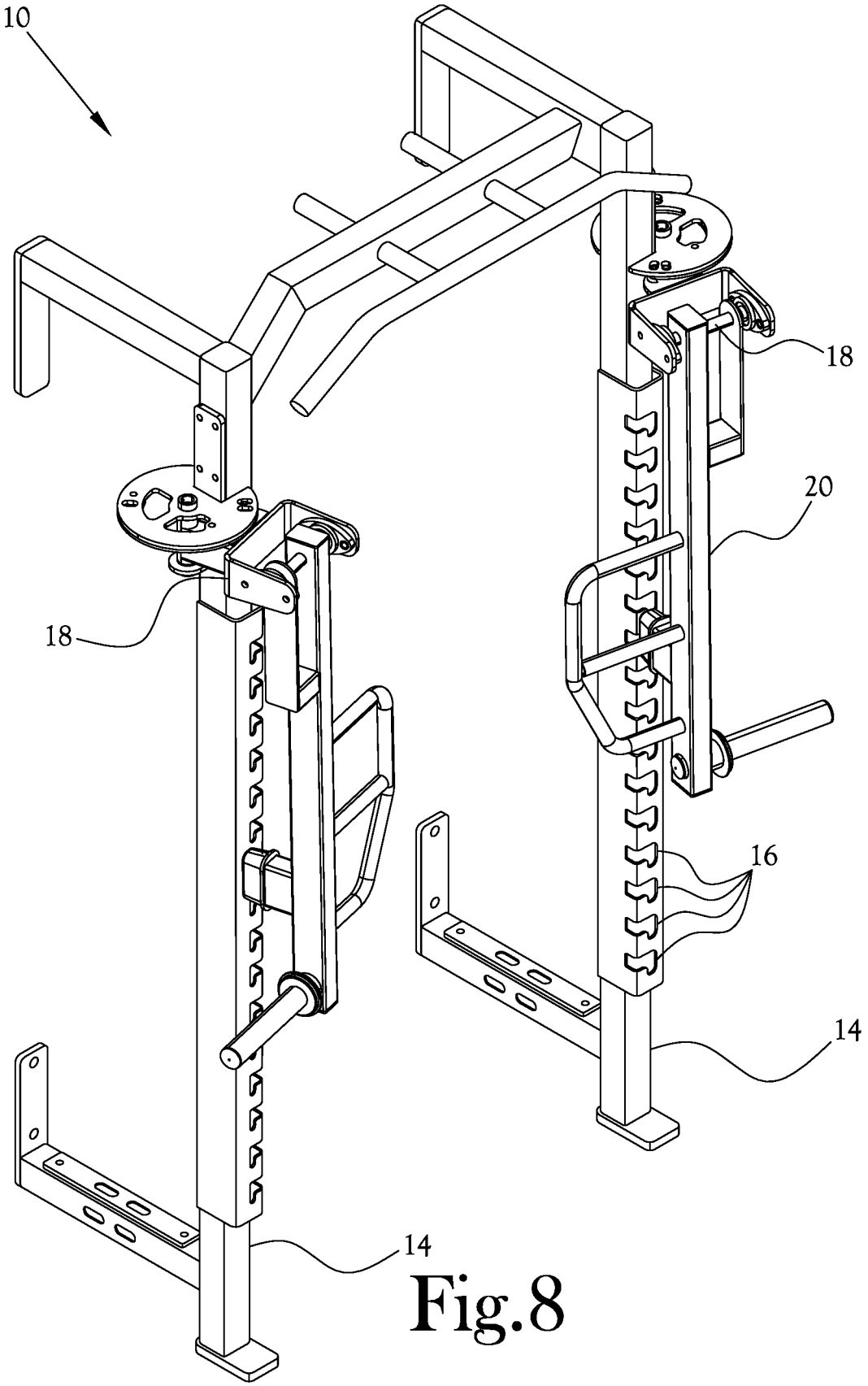
FIG. 8 illustrates the weight lifting system of FIG. 1 with the weight arm assemblies positioned for a converging press exercise according to an example embodiment of the present general inventive concept.
Figure 9:
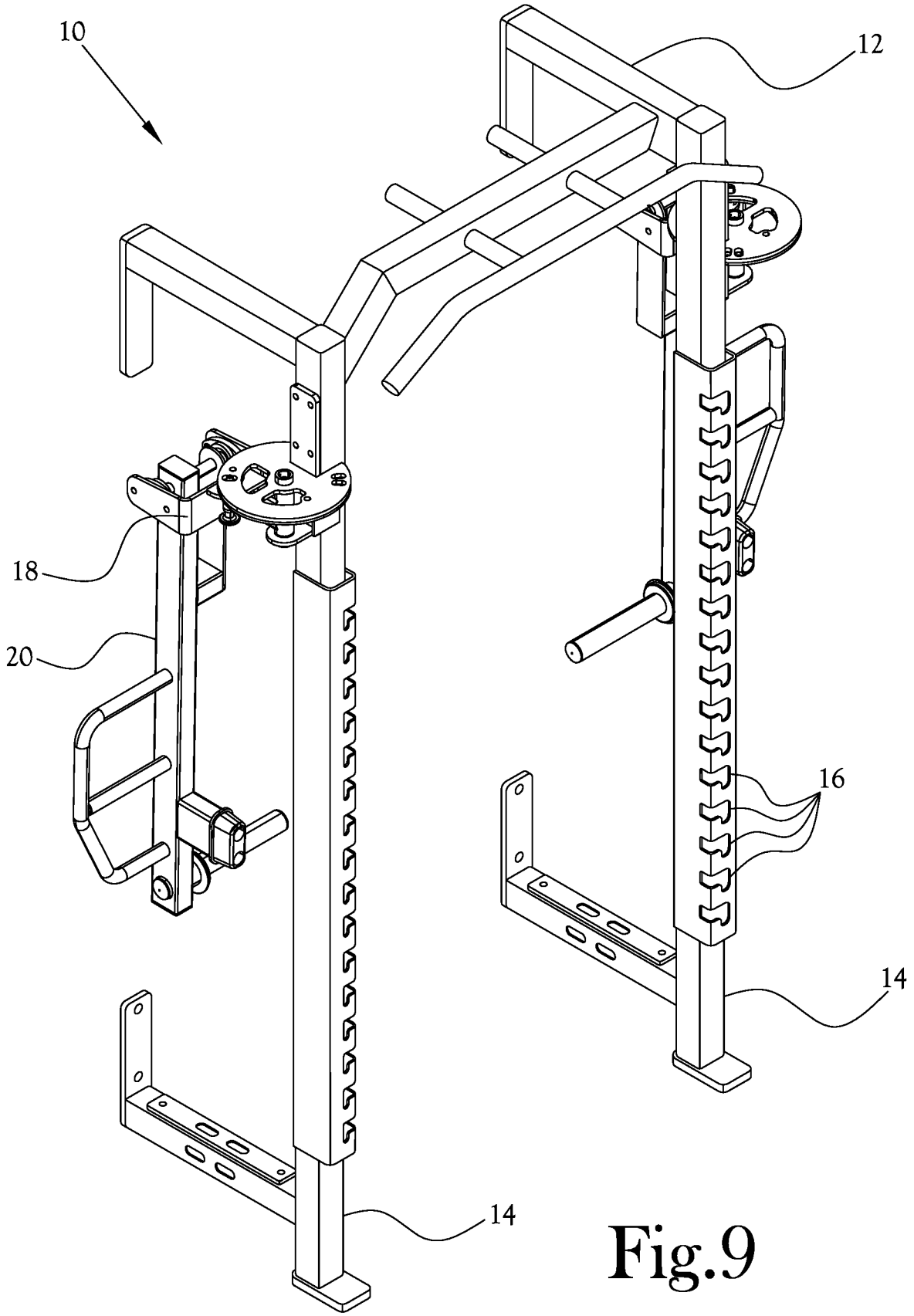
FIG. 9 illustrates the weight lifting system of FIG. 1 with the weight arm assemblies moved to the stowed position according to an example embodiment of the present general inventive concept.

FIG. 8 illustrates the weight lifting system of FIG. 1 with the weight arm assemblies 18 positioned for the converging press exercise according to an example embodiment of the present general inventive concept, and FIG. 9 illustrates the weight lifting system of FIG. 1 with the weight arm assemblies 18 moved to the stowed position according to an example embodiment of the present general inventive concept. As shown in FIG. 9, the weight arm assemblies 18 have been stowed away and secured in position such that the upright members 14 have plenty of open room and accessible attachment portions 16 to perform other exercises and/or install other equipment, and the user may conveniently at any time bring the weight arm assemblies 18 back into position for use by simply pulling on the pull pin stop member 72 and rotating the weight arm 20 back into one of the front positions, at which point the stop member 72 will be engaged with another receiving portion 66 of the mounting bracket 50 to stay in place for the user to employ the weight arms 20 in his workout. As previously noted, the respective weight arm assemblies 18 are configured with components to rotate clockwise to be stowed and counter-clockwise to be used, or clockwise to be used and counter clockwise to be stowed, depending upon whether the respective weight arm assemblies 18 are configured to be attached to the right or left upright members 14 or other similarly arranged vertical surfaces.

Various example embodiments of the present general inventive concept may provide a weight arm assembly for use with a weight lifting rack is provided, the weight arm assembly including a mounting bracket configured to be attached to a vertical surface in a fixed position, an arm mount configured to be coupled to the assembly mount so as to be pivotable about a first axis, a stop member coupled to the arm mount and configured to move between an engaged position to prevent pivoting of the arm mount through interaction with the mounting bracket, and a disengaged position to allow pivoting of the arm mount, and a weight arm configured to be coupled to the arm mount, proximate a first end of the weight arm, so as to be pivotable about a second axis substantially orthogonal to the first axis. The stop member may be biased in a direction toward the engaged position. The mounting bracket may include a plurality of receiving portions respectively configured to receive at least a portion of the stop member at a plurality of rotational positions of the arm mount to allow the stop member to move to the engaged position to prevent pivoting of the arm mount. The plurality of rotational positions may include a first position to place the arm mount and weight arm in a non-use position, and a second position to place the arm mount and weight arm in a straight press position. The first position may be approximately 180 degrees around the vertical axis from the second position. The plurality of rotational positions may include a third position to place the arm mount and weight arm in a converging press position. The plurality of rotation positions may include a fourth position to place the arm mount and weight arm in a diverging press position. The stop member may be configured with a cylinder shape and to be oriented substantially vertically when the mounting bracket is attached to the vertical surface, and the stop member may be configured with a gripping portion at an exposed bottom end such that the stop member is moved to the disengaged position by a user pulling downward on the gripping portion. A top end of the stop member may contact a bottom surface of a portion of the mounting bracket on which the receiving portions are formed during rotational movement of the arm mount. The mounting bracket may include a contact plate configured such that one side of the contact plate contacts the vertical surface when the mounting bracket is attached to the vertical surface, and the contact plate may have a plurality of through holes to receive fixing members to fix the contact plate to the vertical surface. The mounting bracket may include a mounting portion to be fixed to the vertical surface, a top bracket member extending horizontally from the mounting portion, and a bottom bracket member extending horizontally from the mounting portion and below the top bracket member, wherein the top and bottom bracket members are formed with corresponding aligned receiving portions configured to respectively receive opposite ends of a coupling member aligned with the first axis to couple the arm mount to the mounting bracket. The arm mount may include a bushing configured receive the coupling member received through the corresponding aligned receiving portions of the mounting bracket to form a rotational coupling such that the bushing is rotatable about the coupling member, a spacer member extending orthogonally from the bushing and a horizontal bracket including a back portion attached to an end of the spacer member opposite the bushing, and two side members extending respectively from opposite ends of the back portion, wherein the two side members of the horizontal bracket are configured with corresponding aligned spindle receiving portions on facing surfaces to form the second axis about which the first end of the weight arm is pivotable. The weight arm may include a spindle proximate the first end of the weight arm, the spindle being configured to be held in rotatable register by the corresponding aligned spindle receiving portions of the horizontal bracket of the arm mount. The weight arm may include a spindle proximate the first end of the weight arm, the spindle being configured to be rotatable about the second axis, a front surface facing away from the first axis, a back surface configured with a bumper extending away from the back surface proximate a second end of the weight arm to prevent the weight arm from contacting a surface facing the weight arm. The weight arm may further include at least one handle extending from one side of the weight arm, and a load hook extending from an opposite side of the weight arm to receive weights thereon. The at least one handle may include a multi-handle configuration including at least two horizontal handles and at least one connecting handle extending from ends of the at least two horizontal handles opposite the weight arm.

Various example embodiments of the present general inventive concept may provide a weight lifting system including a weight lifting rack having at least two corresponding upright members configured to hold at least a weight lifting bar therebetween, and a pair of weight arm assemblies configured to be respectively attached to the upright members of the weight lifting rack, each of the weight arm assemblies respectively including a mounting bracket configured to be attached to one of the upright members in a fixed position facing away from a space between the upright members, an arm mount configured to be coupled to the assembly mount so as to be pivotable about a first axis, a stop member coupled to the arm mount and configured to move between an engaged position to prevent pivoting of the arm mount through interaction with the mounting bracket, and a disengaged position to allow pivoting of the arm mount, and a weight arm configured to be coupled to the arm mount, proximate a first end of the weight arm, so as to be pivotable about a second axis substantially orthogonal to the first axis. The pair of weight arm assemblies may be configured in opposite arrangements relative to one another such that each of the weight arm assemblies is rotatable from a position in which the weight arms are facing in a forward direction relative to the weight lifting rack, to a position in which in which the weight arms are facing away from one another, to a position in which the weight arms are facing in a backward direction relative to the weight lifting rack. Each of the mounting brackets may include a center mounting plate configured to be attached to a side of the upright members facing away the space between the upright members, and a pair of reinforcement members extending from opposite sides of the center mounting plate to contact adjacent sides of the upright members. Each of the weight arm assemblies may be configured such that the arm mount can be held in place by the stop members in at least one position in which the weight arms are facing a forward direction of the weight lifting rack when in use, and in at least one position in which the weight arms are facing away from the weight lifting rack when not in use.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A weight arm assembly for use with a weight lifting rack, the weight arm assembly comprising:

a mounting bracket configured to be attached to a vertical surface in a fixed position;

an arm mount configured to be coupled to the mounting bracket so as to be pivotable about a first axis;

a stop member coupled to the arm mount and configured to move between an engaged position to prevent pivoting of the arm mount through interaction with the mounting bracket, and a disengaged position to allow pivoting of the arm mount; and a weight arm configured to be coupled to the arm mount, proximate a first end of the weight arm, so as to be pivotable about a second axis substantially orthogonal to the first axis;

wherein the mounting bracket comprises:

a mounting portion to be fixed to the vertical surface, a top bracket member extending horizontally from the mounting portion, and a bottom bracket member extending horizontally from the mounting portion and below the top bracket member, the top and bottom bracket members being formed with corresponding aligned receiving portion configured to respectively receive opposite ends of a coupling member aligned with the first axis to couple the arm mount to the mounting bracket; and wherein the arm mount comprises:

a bushing configured receive the coupling member received through the corresponding aligned receiving portion of the mounting bracket to form a rotational coupling such that the bushing is rotatable about the coupling member, a spacer member extending orthogonally from the bushing, and a horizontal bracket including a back portion attached to an end of the spacer member opposite the bushing, and two side members extending respectively from opposite ends of the back portion, the two side members of the horizontal bracket being configured with corresponding aligned spindle receiving portion on facing surfaces to form the second axis about which the first end of the weight arm is pivotable.

2. The weight arm assembly of claim 1, wherein the stop member is biased in a direction toward the engaged position.

3. The weight arm assembly of claim 2, wherein the mounting bracket includes a plurality of stop member receiving portions respectively configured to receive at least a portion of the stop member at a plurality of rotational positions of the arm mount to allow the stop member to move to the engaged position to prevent pivoting of the arm mount.

4. The weight arm assembly of claim 3, wherein the plurality of rotational positions includes a first position to place the arm mount and weight arm in a non-use position, and a second position to place the arm mount and weight arm in a straight press position.

5. The weight arm assembly of claim 4, wherein the first position is approximately 180 degrees around a vertical axis from the second position.

6. The weight arm assembly of claim 4, wherein the plurality of rotational positions includes a third position to place the arm mount and weight arm in a converging press position.

7. The weight arm assembly of claim 6, wherein the plurality of rotation positions includes a fourth position to place the arm mount and weight arm in a diverging press position.

8. The weight arm assembly of claim 3, wherein the stop member is configured with a cylinder shape and to be oriented substantially vertically when the mounting bracket is attached to the vertical surface; and the stop member is configured with a gripping portion at an exposed bottom end such that the stop member is moved to the disengaged position by a user pulling downward on the gripping portion.

9. The weight arm assembly of claim 8, wherein a top end of the stop member contacts a bottom surface of a portion of the mounting bracket on which the stop member receiving portions are formed during rotational movement of the arm mount.

10. The weight arm assembly of claim 1, wherein the weight arm comprises:

a spindle proximate the first end of the weight arm, the spindle being configured to be rotatable about the second axis;

a front surface facing away from the first axis;

a back surface configured with a bumper extending away from the back surface proximate a second end of the weight arm to prevent the weight arm from contacting a surface facing the weight arm.

11. The weight arm assembly of claim 10, wherein the weight arm further comprises:

at least one handle extending from one side of the weight arm; and a load hook extending from an opposite side of the weight arm to receive weights thereon.

12. The weight arm assembly of claim 11, wherein at least one handle comprises a multi-handle configuration including at least two horizontal handles and at least one connecting handle extending from ends of the at least two horizontal handles opposite the weight arm.

13. The weight arm assembly of claim 1, wherein the mounting bracket comprises a contact plate configured such that one side of the contact plate contacts the vertical surface when the mounting bracket is attached to the vertical surface, the contact plate having a plurality of through holes to receive fixing members to fix the contact plate to the vertical surface.

14. The weight arm assembly of claim 1, wherein the weight arm comprises a spindle proximate the first end of the weight arm, the spindle being configured to be held in rotatable register by the corresponding aligned spindle receiving portion of the horizontal bracket of the arm mount.

15. A weight lifting system comprising:

a weight lifting rack having at least two corresponding upright members configured to hold at least a weight lifting bar therebetween; and a pair of weight arm assemblies configured to be respectively attached to the upright members of the weight lifting rack, each of the weight arm assemblies respectively comprising:

a mounting bracket configured to be attached to one of the upright members in a fixed position facing away from a space between the upright members, an arm mount configured to be coupled to the mounting bracket so as to be pivotable about a first axis, a stop member coupled to the arm mount and configured to move between an engaged position to prevent pivoting of the arm mount through interaction with the mounting bracket, and a disengaged position to allow pivoting of the arm mount, and a weight arm configured to be coupled to the arm mount, proximate a first end of the weight arm, so as to be pivotable about a second axis substantially orthogonal to the first axis;

wherein the mounting bracket comprises:

a mounting portion to be fixed to the vertical surface, a top bracket member extending horizontally from the mounting portion, and a bottom bracket member extending horizontally from the mounting portion and below the top bracket member, the top and bottom bracket members being formed with corresponding aligned receiving portion configured to respectively receive opposite ends of a coupling member aligned with the first axis to couple the arm mount to the mounting bracket; and wherein the arm mount comprises:

a bushing configured receive the coupling member received through the corresponding aligned receiving portion of the mounting bracket to form a rotational coupling such that the bushing is rotatable about the coupling member, a spacer member extending orthogonally from the bushing, and a horizontal bracket including a back portion attached to an end of the spacer member opposite the bushing, and two side members extending respectively from opposite ends of the back portion, the two side members of the horizontal bracket being configured with corresponding aligned spindle receiving portion on facing surfaces to form the second axis about which the first end of the weight arm is pivotable.

16. The weight lifting system of claim 15, wherein the pair of weight arm assemblies are configured in opposite arrangements relative to one another such that each of the weight arm assemblies is rotatable from a position in which the weight arms are facing in a forward direction relative to the weight lifting rack, to a position in which in which the weight arms are facing away from one another, to a position in which the weight arms are facing in a backward direction relative to the weight lifting rack.

17. The weight lifting system of claim 16, wherein the mounting portions of each of the mounting brackets comprises:

a center mounting plate configured to be attached to a side of the upright members facing away the space between the upright members; and a pair of reinforcement members extending from opposite sides of the center mounting plate to contact adjacent sides of the upright members.

18. The weight lifting system of claim 16, wherein each of the weight arm assemblies are configured such that the arm mount can be held in place by the stop members in at least one position in which the weight arms are facing a forward direction of the weight lifting rack when in use, and in at least one position in which the weight arms are facing away from the weight lifting rack when not in use.

* * * * *